US012342898B2

(12) United States Patent
Franke et al.

(10) Patent No.: US 12,342,898 B2
(45) Date of Patent: Jul. 1, 2025

(54) SAFETY HELMET WITH A SHEATHED BEARING ELEMENT, PROCESS FOR REMOVING THE SHEATHING FROM THE SAFETY HELMET AND PROCESS FOR MANUFACTURING SUCH A SAFETY HELMET

(71) Applicant: Dräger Safety AG & Co. KGaA, Lübeck (DE)

(72) Inventors: Katja Franke, Lübeck (DE); Steffen Pracht, Lübeck (DE); Jasser Rahmatyan, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 0 days.

(21) Appl. No.: 18/625,338

(22) Filed: Apr. 3, 2024

(65) Prior Publication Data

US 2024/0245162 A1 Jul. 25, 2024

Related U.S. Application Data

(62) Division of application No. 17/242,751, filed on Apr. 28, 2021, now Pat. No. 11,992,079.

(30) Foreign Application Priority Data

Apr. 30, 2020 (DE) ..... 102020002612.5

(51) Int. Cl.
*A42B 3/32* (2006.01)
*A42B 3/14* (2006.01)

(52) U.S. Cl.
CPC ..... *A42B 3/324* (2013.01); *A42B 3/14* (2013.01)

(58) Field of Classification Search
CPC ..... A42B 3/324; A42B 3/14; A42B 3/124; A42B 3/145
See application file for complete search history.

(56) References Cited

U.S. PATENT DOCUMENTS 1,084,596 A * 1/1914 Alexander ..... A42C 5/02 2/181
2,802,212 A * 8/1957 Finken ..... A42B 3/14 2/416
3,253,281 A * 5/1966 Benner ..... A42B 3/14 2/417
3,354,468 A * 11/1967 Bowers, Jr. ..... A42B 3/142 2/421

(Continued)

*Primary Examiner* — Jameson D Collier
(74) *Attorney, Agent, or Firm* — McGlew and Tuttle, P.C.

(57) ABSTRACT

A safety helmet (100) with a helmet shell (7), with a bearing element (5), with at least one holding element (2, 9.*l*, 9.*r*, 28) and with a tubular shape textile sheathing. Each holding element (2, 9.*l*, 9.*r*, 28) is permanently connected to the helmet shell (7). A distance is present between a holding element (2, 9.*l*, 9.*r*, 28) and the head of a user of the safety helmet (100). The bearing element (5) is adjacent to the head. The textile sheathing encloses the bearing element (5) and is located in some areas between the bearing element (5) and the head. The bearing element (5) is detachably connectable to a respective holding element through at least one connection opening in the textile sheathing. A process for removing the textile sheathing from the safety helmet (100), as well as to a process for manufacturing a safety helmet (100) are provided.

19 Claims, 10 Drawing Sheets

(56) References Cited

U.S. PATENT DOCUMENTS 3,590,388 A * 7/1971 Holt ..... A42B 3/14 2/420
3,600,713 A * 8/1971 Holt ..... A42B 3/14 2/909
3,714,668 A * 2/1973 Mirabella ..... A42B 3/145 2/419
4,675,919 A * 6/1987 Heine ..... A61B 90/50 2/181
5,613,248 A * 3/1997 Young ..... A42C 5/02 2/209.13
5,826,279 A * 10/1998 Tencer ..... A42B 3/10 2/416
7,770,239 B1 * 8/2010 Goldman ..... A42B 3/142 2/418
9,578,915 B2 * 2/2017 Pfanner ..... A42B 3/0406
11,992,079 B2 * 5/2024 Franke ..... A42B 3/14
2005/0015856 A1 * 1/2005 Long ..... A42B 3/127 2/414
2005/0034214 A1 * 2/2005 Nunnery ..... A42C 5/02 2/181
2005/0183188 A1 * 8/2005 Rudolf ..... A42B 3/127 2/414
2005/0204456 A1 * 9/2005 Piper ..... A42B 3/00 2/411
2006/0010568 A1 * 1/2006 Wiles ..... A42B 3/10 2/181
2010/0043126 A1 * 2/2010 Morel ..... A42B 3/32 2/421
2017/0000417 A1 * 1/2017 Zhavoronkov ..... A61B 5/7455
2021/0337915 A1 * 11/2021 Franke ..... A42B 3/324

* cited by examiner

A - A

SAFETY HELMET WITH A SHEATHED BEARING ELEMENT, PROCESS FOR REMOVING THE SHEATHING FROM THE SAFETY HELMET AND PROCESS FOR MANUFACTURING SUCH A SAFETY HELMET

CROSS REFERENCE TO RELATED APPLICATIONS

This application is a divisional application of pending U.S. patent application Ser. No. 17/242,751, filed Apr. 28, 2021, and claims the benefit of priority under 35 U.S.C. § 119 of German Application 102020002612.5, filed Apr. 30, 2020, the entire contents of each application are incorporated herein by reference.

TECHNICAL FIELD

The present invention pertains to a safety helmet with a helmet shell, with at least one holding element on the inside at the helmet shell and with a bearing element, which is enclosed by a textile sheathing. The present invention pertains, furthermore, to a process for removing the textile sheathing from the safety helmet as well as to a process for manufacturing a safety helmet with a sheathed bearing element.

BACKGROUND

A safety helmet protects the head of a user from mechanical, thermal and/or chemical environmental effects. The safety helmet usually comprises an arched helmet shell made of a hard material as well as a bearing element, for example, a bearing ring, which comes into contact with the head of the user of the safety helmet.

The safety helmet (hard hat 10) described in US 2017/0000417 A1 comprises a helmet shell (outer shell 12) and an adjustable head band assembly (adjustable suspension band assembly 14) in the interior of the helmet shell 12. A horizontal head band (bearing loop 22) of the assembly 14 as well as additional band led over the head at the top (straps 26) enclose the head of a user of the safety helmet 10. An assembly 24 with biometric sensors as well as a haptic motor 48 are mounted in or at the horizontal head band 22. A sheathing (cover or sweat band 34) is located between the forehead of the user, on the one hand, and the sensors 32 and the motor 34, on the other hand. The sheathing 34 can be removed to be cleaned. Holes 36 are arranged at certain locations in the sheathing 34 in order for the sensors 32 to be able to detect more accurate measured values from the user.

SUMMARY

A basic object of the present invention is to provide a safety helmet with a helmet shell and with a bearing element, wherein the safety helmet reduces the risk of exposure of the user to a certain type of health hazards compared to prior-art safety helmets. In addition, the basic object of the present invention is to provide a process for removing the textile sheathing from a safety helmet and a process for manufacturing a safety helmet.

The present invention is accomplished by a safety helmet according to the invention. Advantageous embodiments of the safety helmet according to the present invention are, insofar as meaningful, also advantageous embodiments of at least one process according to the present invention and vice versa.

The safety helmet according to the present invention comprises

- an arched helmet shell,
- a bearing element,
- at least one holding element, optionally a plurality of holding elements, and
- a tubular shape (tubular configuration) textile sheathing.

The holding element or each holding element is connected permanently to the helmet shell. The terms "rigid connection" and "permanently connected" designate a fixed connection that is not severed at least during the use of the safety helmet, i.e., when the safety helmet is positioned on the head of a user of the safety helmet, or while the safety helmet is kept ready or is cleaned. It is possible that this connection is severed outside a use in order to repair or to replace the holding element or a holding element. It is also possible that a holding element cannot be separated without destruction from the helmet shell.

When the safety helmet is located on the head of a user of the safety helmet, a distance develops (is present) between the holding element or each holding element and the head. The bearing element is in contact with the head. The bearing element is connected detachably to the holding element or to a respective holding element or it can be connected detachably to a holding element. This connection can preferably be established and severed again without the use of a tool.

The textile sheathing encloses the bearing element. An area of the textile sheathing is located between the bearing element and the head.

The textile sheathing has at least one connection opening. The detachable connection or each detachable connection between the bearing element and the holding element or a respective holding element is passed through the connection opening or a respective connection opening in the textile sheathing. A respective detachable connection is preferably established between the sheathed bearing element and a respective holding element through each connection opening of the textile sheathing.

The bearing element in the textile sheathing can be detached according to the present invention from the holding element or from each holding element and it can subsequently be removed from the safety helmet, together with the textile sheathing. The sheathed bearing element can again be inserted into the safety helmet and be connected detachably to the holding element or to each holding element in the process.

The bearing element is in contact according to the present invention with the head of a user of the safety helmet and it encloses at least a part of the head. As a result, the bearing element contributes to a sufficiently stable seating of the safety helmet on the head of the user, as a result of which it cannot slip to a considerable extent.

According to the present invention, an area of the textile sheathing is located between the bearing element and the head. As a result, the head does not come directly into contact with the bearing element. This feature increases in many cases the wearing comfort because the textile sheathing is, as a rule, softer and/or more elastic than the bearing element and it therefore brings about a certain cushioning. The bearing element may be firmly in contact with the head of the user without pressing. The textile sheathing is in many cases suitable for absorbing sweat.

According to the present invention, the textile sheathing encloses the bearing element. Each connection, which detachably connects the bearing element to the holding element or to a respective holding element, is passed through the connection opening or each connection opening in the textile sheathing. There optionally are a plurality of connections and connection openings, and each connection is passed through a respective connection opening. Thanks to these features, an area of the textile sheathing is located between the bearing element being held detachably, on the one hand, and the holding element or the holding elements and hence the helmet shell, on the other hand. As a result, the textile sheathing is held in the interior of the helmet shell without a mechanical connection of the textile sheathing to the bearing element or to a holding element or to another component of the safety helmet being necessary. Therefore, no connection in substance, especially no bonded connection or welded connection and not even a VELCRO® connection, a type of hook-and-loop fastener, of the textile sheathing to another component of the safety helmet is necessary. In particular, it is not necessary to connect the sheathing by connection in substance to the bearing element. A connection by connection in substance, e.g., a bonded connection or a welded connection, would often only be able to be separated with a considerable effort. A VELCRO® connection may become worn or soiled. There is a risk that a worn or soiled VELCRO® connection cannot achieve the desired connecting effect any longer after a period of use.

The textile sheathing must be cleaned from time to time. Such cleaning is necessary especially for the following reasons. When the user uses the safety helmet in an environment contaminated with pollutants, particles of harmful substances may be deposited on the textile sheathing or even penetrate into same. Especially CO and HCN particles may be deposited on the textile sheathing in a room that is contaminated by fumes and/or particles of harmful substances. The textile sheathing does, in addition, come into contact with the scalp of the user. The textile sheathing must therefore be cleaned thoroughly after a use.

The textile sheathing shall, as a rule, be cleaned separately from the helmet shell and from the holding element or from each holding element. One possibility is to remove only the textile sheathing from the safety helmet and to clean it. This procedure requires that the textile sheathing be separated from the bearing element and it is therefore relatively time-consuming in many cases.

Even though the present invention does make this procedure possible in many cases, it eliminates the need to separate the textile sheathing from the rest of the safety helmet for the cleaning. To separate the bearing element from the holding element or from the holding elements, it is not necessary thanks to the present invention to remove the bearing element from the textile sheathing. The sheathed bearing element, i.e., the bearing element together with the textile sheathing, can rather be separated from the holding element or from each holding element and be removed from the safety helmet. If the bearing element is manufactured from a material that is suitable for this purpose, it can be cleaned together with the textile sheathing, i.e., in the textile sheathing, and it can then be inserted again into the safety helmet.

It is not necessary thanks to the present invention to separate the holding element or a holding element from the helmet shell in order to remove the sheathed bearing element or only the textile sheathing from the safety helmet. The detachable connection or each detachable connection between the bearing element and the holding element or a holding element preferably is a snap connection, a snap-in connection or a click connection. As a result, the detachable connection can be established and severed again without the use of a tool. A screw connection is also possible between the bearing element and the holding element.

The present invention makes it possible to provide two different bearing elements for the same safety helmet, wherein each bearing element is enclosed by a respective textile sheathing. The one textile sheathing or the other textile sheathing can be optionally inserted into the safety helmet. This makes it possible to use the safety helmet with one sheathed bearing element, while the other sheathed bearing element is being cleaned or is kept ready. It is possible that the two bearing elements differ from one another in at least one dimension. It is also possible that the two textile sheathings differ from one another concerning a dimension or a material. As an alternative, the two bearing elements and the two textile sheathings may have an identical configuration.

The textile sheathing preferably comprises at least two connection openings, which are located at spaced locations from one another, and especially preferably three connection openings located at spaced locations from one another. The bearing element can be connected to the holding element or to a respective holding element through each connection opening. Thanks to this embodiment, the bearing element is held at at least two and preferably even at at least three connection points located at spaced locations from one another. This embodiment reduces, on the one hand, the risk of movement of the sheathed bearing element relative to the helmet shell, while a user is using the safety helmet on the user's head, and, on the other hand, it reduces the risk of slipping of the textile sheathing relative to the bearing element or a movement of the textile sheathing in another manner. The sheathed bearing element is held securely in the helmet shell, without a connection by connection in substance or a VELCRO® connection being necessary.

In a variant of this embodiment, the safety helmet comprises at least two holding elements, and each holding element is arranged on the inside in the helmet shell and is permanently connected (fixed) to the helmet shell. The bearing element is connected or can be connected detachably to both holding elements or to at least two different holding elements. Each detachable connection passes through a respective connection opening.

In one embodiment, the bearing element and both holding elements or two holding elements, to which the bearing element is detachably connected, form together a bearing ring, which fully encloses the head of a user of the safety helmet. This bearing ring sets the head size, which the safety helmet provides. It is desirable, as a rule, to be able to change this head size in order to be able to adapt the safety helmet to the shape and/or to the size of the head of the user. Thanks to the variable head size, a plurality of safety helmets of identical design can be provided for different users. The same user can use the safety helmet optionally with or without a head cover, such a head cover being arranged between the head and the safety helmet.

To make it possible to provide a variable head size, the one holding element is movable according to this embodiment relative to the other holding element. Both holding elements, to which the bearing element is connected detachably, are especially preferably movable relative to the helmet shell. The head size, which is provided by the safety helmet, is changed by one holding element being moved relative to the other holding element.

In one embodiment, the safety helmet comprises a spacer, which is permanently connected to the helmet shell. This spacer holds the two holding elements, to which the sheathed bearing element is or can be detachably connected. Thanks to the spacer, the two holding elements are connected indirectly permanently to the helmet shell. The spacer ensures that a distance is formed between the two holding elements and the head of a user. Thanks to this spacer, it is not necessary to also provide the two holding elements with a respective textile sheathing. Nevertheless, the spacers do not come into contact with the head of the user.

These two embodiments may be combined with one another. The spacer holds the two holding elements, which are detachably connected to the bearing element and are movable relative to one another. The two holding elements, but at least one holding element, are/is preferably movable relative to the spacer. The spacer may be connected mechanically to an actuating element, for example, to a handwheel. A user can change the head size provided by means of this actuating element.

The detachable connection or at least one detachable connection and preferably each detachable connection is preferably established between the bearing element and the holding element or a holding element by means of a snap connection or a snap-in connection. The detachable connection can be established and severed again without a tool being necessary for this purpose. In one embodiment of such a snap connection or snap-in connection, the bearing element comprises a projection, preferably a mushroom-shaped projection. The holding element comprises a corresponding recess. In another embodiment, the holding element comprises a projection and the bearing element a corresponding recess. In both embodiments, the projection or each projection is passed through the connection opening or a respective connection opening and it meshes with the corresponding recess when the sheathed bearing element is inserted. The recess or each recess overlaps the connection opening or a respective connection opening of the textile sheathing, so that the projection can be passed through the textile sheathing.

According to the present invention, the sheathed bearing element can be detached from the holding element or from each holding element and be removed from the safety helmet. The bearing element and the textile sheathing are preferably configured such that the bearing element cannot slide, slip or fall out of the textile sheathing, not even after the sheathed bearing element has been removed from the safety helmet. This embodiment makes it especially easy to remove the sheathed bearing element from the safety helmet and to clean the textile sheathing together with the bearing element or to keep it ready, without the bearing element having to be removed from the textile sheathing.

In one embodiment, the textile sheathing has the form of a hose (a hose configuration). This hose is, as a rule, limp. The hose has two ends, both of which are closed. The connection opening or each connection opening has a respective distance to each end of the hose (tube). The two ends are closed. Since the ends are closed and each connection opening is located at a spaced location from both ends, the bearing element cannot slip out of the textile sheathing through an end of the hose. Each connection opening is preferably so small that the bearing element cannot slip out of the textile sheathing through the connection opening.

In one embodiment, the bearing element is brought into the textile sheathing during the manufacture of the safety helmet, and the textile sheathing is closed with the exception of the connection opening or each connection opening. For example, a piece of a textile material is placed around the bearing element, and two ends of the material are sewn together or joined together in another manner, and the textile sheathing is prepared thereby. The bearing element cannot then be removed from the textile sheathing without damaging the textile sheathing.

In another embodiment, two hoses (two hose portions) are prepared from a textile material, and each hose portion has an open end and a closed end and it optionally has at least one connection opening located at a spaced location from the ends. The two hoses (hose portions) are removed from two sides over the bearing element and are connected to one another at their open ends. The bearing element is then enclosed fully by the textile sheathing with the exception of the connection openings, and the sheathing is formed by the two hose portions connected to one another. It is possible that the connection opening or a connection opening is formed at the edge at which the two hoses are connected to one another. It is possible that the bearing element cannot be removed from the textile sheathing any longer after the two hoses have been connected to one another.

In one embodiment, a connection opening of the textile sheathing is additionally configured as an insertion opening. Every other connection opening is located at a spaced location from this insertion opening. The bearing element can be inserted into the textile sheathing through the insertion opening. This embodiment makes it possible to manufacture the bearing element and the textile sheathing separately from one another.

In one embodiment, this insertion opening is present only during the manufacture of the safety helmet, and it is suitable for the insertion of the bearing element. After the bearing element has been inserted into the textile sheathing, the insertion opening is closed completely or is reduced by placing a closure. A detachable connection can be established through the reduced opening between the bearing element and the holding element or a holding element, and the reduced opening consequently acts as the connection opening or a connection opening. However, the bearing element cannot be removed from the textile sheathing through the reduced opening.

In another embodiment, the bearing element can again be removed out of the textile sheathing through the insertion opening. This embodiment makes it easier to clean the textile sheathing separately from the bearing element or also to replace a worn textile sheathing by a new textile sheathing. The bearing element can continue to be used.

The bearing element and/or the textile sheathing are preferably configured such that the bearing element cannot slide or slip by itself out of the textile sheathing through the insertion opening, but only when it is compressed.

In one embodiment, the textile sheathing comprises two hoses. The insertion opening is located between these two hoses. Each hose has therefore an end, which is located at a spaced location from the insertion opening. This end located at a distance is closed in order for the bearing element not to be able to slide out of the textile sheathing. Each hose occupies a respective area of the bearing element. The other connection opening or each other connection opening is located in a respective hose each. The two hoses are preferably minor-symmetrical to one another in relation to the insertion opening.

This embodiment makes it possible to pull the two hoses over the two areas of the bearing element during the manufacture of the safety helmet and subsequently to connect the two hoses to one another such that the insertion opening is formed. The bearing element can again be removed from the textile sheathing through this insertion opening.

In one embodiment, the bearing element has the shape of an elliptical segment, especially of a circle segment. The bearing element having such a shape is preferably in contact with the forehead of a user of the safety helmet, and an area of the textile sheathing is located between the forehead and the bearing element. The holding element or at least one holding element also has the shape of an elliptical segment, especially of a circle segment, in one embodiment, and this elliptical segment is in contact on the inside with the arched helmet shell. It is also possible that the holding element or at least one holding element has the shape of a punctiform coupling point at the helmet shell.

In one embodiment, the bearing element can be reversibly compressed, for example, in the manner of tongs. The bearing element exerts a restoring force in the compressed state. This restoring force seeks to move the bearing element into a resting state. The textile sheathing is so large that it is capable of receiving the bearing element in the resting state.

In a preferred variant of this embodiment, the bearing element can be brought in the compressed state into the interior of the textile sheathing through the insertion opening. If the bearing element is not compressed any longer in the textile sheathing, a restoring force brings the bearing element into the resting state. The bearing element preferably has a larger dimension than the insertion opening in each direction in the plane of the insertion opening. As a result, the bearing element cannot slide out of the textile sheathing any longer in the resting state, not even through the insertion opening.

In one embodiment, at least the bearing element, the holding element or each holding element, and the tubular shape textile sheathing of a safety helmet according to the present invention are produced by a 3D printer. Different components of the safety helmet are optionally produced by different 3D printers, also at different locations. The helmet shell is likewise produced by a 3D printer in one embodiment and by another manufacturing process in another embodiment. The components are preferably assembled into a safety helmet according to the present invention.

The present invention pertains, on the one hand, to a 3D printer, which is configured to produce the just mentioned components of a safety helmet according to the present invention. In a variant, the present invention pertains to an arrangement with a plurality of 3D printers, which are capable of producing together the above-mentioned components. On the other hand, the present invention pertains to a computer program, which can be executed on a computer. If the computer program is executed on the computer, the computer controls at least one 3D printer. The actuated 3D printer produces the just listed components of the safety helmet according to the present invention. The computer optionally controls a plurality of 3D printers for different components. It is also possible that different computer programs actuate a respective computer each, and each actuated computer produces a respective component of the safety helmet according to the present invention.

The present invention pertains, furthermore, to a process for removing the textile sheathing from a safety helmet according to the present invention. The sheathed bearing element is located before the removal in the interior of the safety helmet and is connected to at least one holding element, namely, through the connection opening or a connection opening. The removal process comprises the following steps:

- The connection or each connection of the sheathed bearing element with the holding element or with a respective holding element is severed.
- The bearing element with the textile sheathing is removed from the safety helmet.

In a variant of this removal process, the bearing element is cleaned along with the textile sheathing after the sheathed bearing element has been removed from the safety helmet. After the sheathed bearing element has been cleaned, it is inserted again into the safety helmet. The bearing element is now connected detachably to the holding element or a respective holding element through the connection opening or through at least one connection opening of the textile sheathing.

The present invention pertains, furthermore, to a process for manufacturing a safety helmet according to the present invention. The manufacturing process comprises the following steps:

- The helmet shell, the bearing element, the holding element or each holding element and a flat object made of a textile material are provided. This flat object may already have the form of a hose and it preferably has at least one connection opening.
- The bearing element is connected to the flat object consisting of the textile material. The tubular shape textile sheathing is formed around the bearing element from the flat object by this connection. The connection opening or each connection opening is recessed into this textile sheathing.
- The holding element or each holding element is permanently connected to the helmet shell.
- The bearing element in the textile sheathing is inserted into the safety helmet. The bearing element is now connected detachably to the holding element or to a respective holding element through the connection opening or through at least one connection opening in the textile sheathing, preferably through each connection opening.

Various embodiments of the step of connecting the bearing element to the flat object consisting of the textile material are possible. In one embodiment, the tubular shape textile sheathing is provided. The textile sheathing provided has an insertion opening and at least one additional connection opening and it acts as the flat object. The insertion opening is preferably located between the two ends of the hose, and these two ends are closed.

The bearing element is inserted through the insertion opening into the textile sheathing. The textile element in the textile sheathing is connected detachably to the holding element or to a respective holding element through the insertion opening and through the additional connection opening or through each additional connection opening.

In a variant of the embodiment with the insertion opening, the bearing element can be reversibly compressed. The compressed bearing element is brought through the insertion opening into the interior of the textile sheathing. The intrinsic restoring force transfers the bearing element into a resting state. The bearing element cannot slide or slip out of the textile sheathing in the resting state.

In another variant of the embodiment with the insertion opening, the following additional steps are carried out after the step of inserting the bearing element through the insertion opening into the interior of the textile sheathing:

- A textile closure is placed on the insertion opening and is connected to the textile sheathing. Due to the textile closure being placed, the insertion opening becomes a connection opening, which is smaller than the insertion opening. The bearing element cannot slip out of the textile sheathing through this connection opening having a reduced size.
- The bearing element is connected to a holding element through the connection opening having a reduced size.

The textile sheathing does not necessarily have an insertion opening in various other embodiments of the manufacturing process.

In the embodiment just described, the flat object already has the form of a hose. In another embodiment, the flat object consisting of a textile material is placed around the bearing element, and two edges of the flat object are connected to one another, so that the tubular shape textile sheathing is formed.

In another embodiment, two hoses made of a textile material are provided, and each hose has an open end and a closed end. The two hoses are removed from two opposite sides over the bearing element, and the two open ends are moved towards one another. The two hoses are connected to one another, for example, sewn together, at the open ends.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
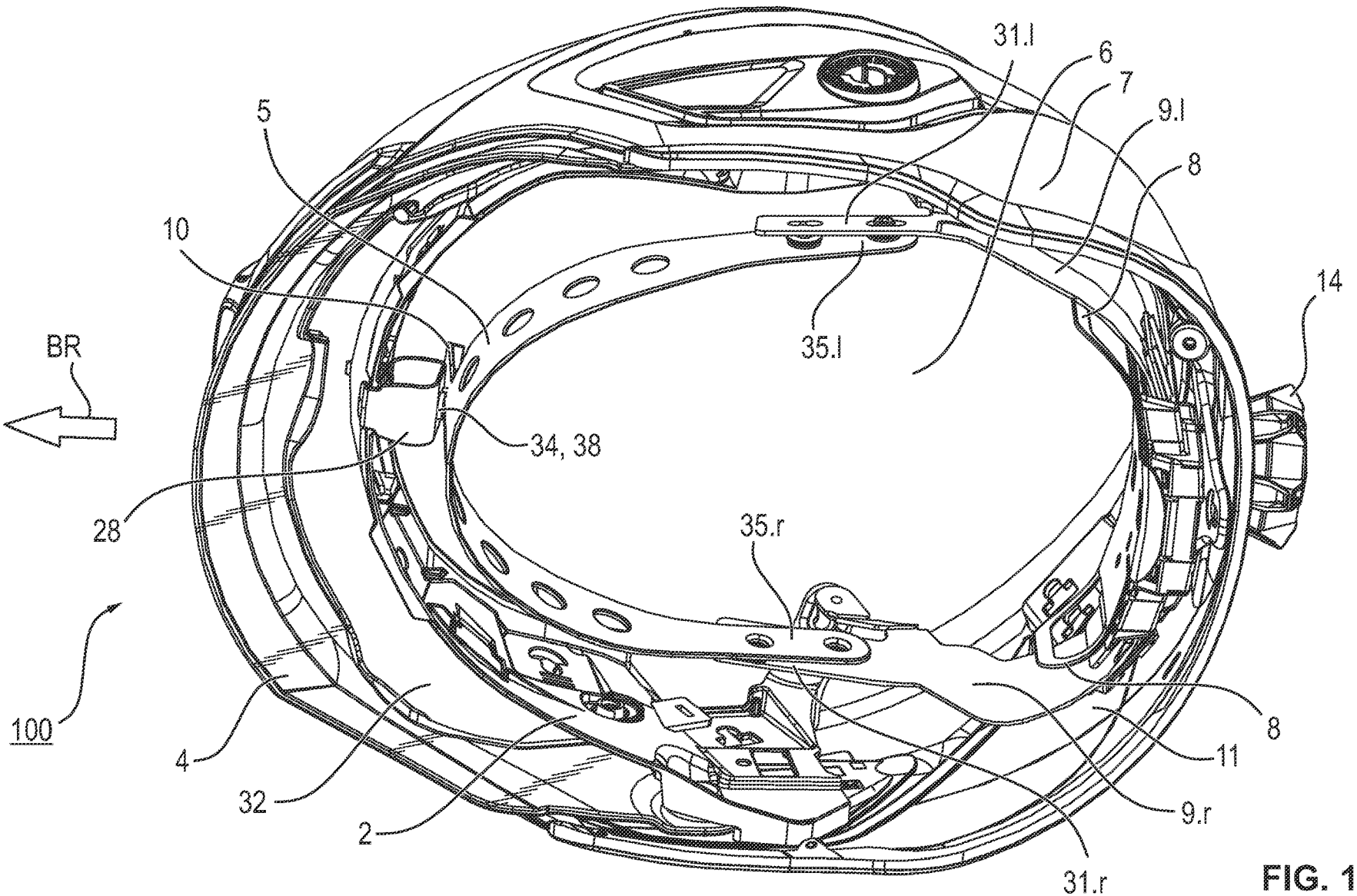
FIG. 1 is a perspective view showing a safety helmet according to the present invention obliquely from below.

Referring to the drawings, the present invention pertains to a safety helmet, which is used by firefighters, police, rescue workers and other rescue teams in order to better protect the head from mechanical, thermal and chemical environmental effects.

The safety helmet according to the exemplary embodiment comprises, just like many prior-art safety helmets, an arched helmet shell made of a hard material, a bearing structure and an inner lining. The inner lining is in contact with the head of a person, who is wearing this safety helmet on the user's head, and it comprises textile components. This person will hereinafter be called "the user."

The designations "left," "right," "front," "rear," top" and "bottom" which will be used below, pertain to the usual orientations when the safety helmet is seated on the head of a user and the user is looking forward. The viewing direction BR of a user looking straight forward is shown in some figures. The inner lining is omitted in the figures.

The bearing structure connects the inner lining to the helmet shell and comprises a sequence with a plurality of parts of a bearing ring, wherein the bearing ring is placed around the head of the user. The bearing ring is manufactured from a flexible material and may adapt itself to a certain degree to the shape of the head of a user. The bearing ring is in contact with the head of the user and sets the head size that is provided by the safety helmet.

FIG. 1 shows in a perspective view from a viewing direction obliquely from below a safety helmet 100 according to the present invention. This safety helmet 100 comprises

- an arched helmet shell 7, which is preferably manufactured from a hard material,
- an arched shock-absorbing shell 6, which is in contact with the helmet shell 7 on the inside and is manufactured from a plastically deformable material in order to absorb kinetic energy,
- a front holding ring part 2, which is in contact on the inside with the shock-absorbing shell 6 and is permanently connected (fixed) to the helmet shell 7,
- a rear holding ring part 11, which is likewise in contact on the inside with the shock-absorbing shell 6 and is permanently connected to the helmet shell 7,
- a face protection in the form of a pivotable visor 4, which is rotatably connected to the helmet shell 7, and which is preferably scratch-resistant and/or mirrored,
- an additional pivotable visor 32 in the form of sunglasses,
- a horseshoe-shaped or U-shaped or semicircular front bearing ring part 5,
- a left lateral rear bearing ring part 9.*l* and a right lateral rear bearing ring part 9.*r*,
- an optional rigid intermediate piece 28 with a recess 38, wherein the intermediate piece 28 connects the front bearing ring part 5 to the front holding ring part 2,
- a central rear bearing ring part in the form of a bearing support 8 for the back of the head, and
- a rotatable handwheel 14 accessible from the outside, with which the head size provided by the safety helmet 100 can be changed.

The front bearing ring part 5

- is reversibly deformable,
- is in contact with the forehead of a user of the safety helmet 100,
- is positioned at a horizontal distance from the front holding ring part 2,
- has a spacer 10 with a projection 34, and
- acts as the bearing element, which is enclosed by the textile sheathing 1.

The front holding ring part 2, the two lateral rear bearing ring parts 9.*l* and 9.*r* and the intermediate piece 28 act as holding elements, which are permanently connected to the helmet shell 7 and to which the front bearing ring part (bearing element) 5 can be detachably connected. The two rear bearing ring parts 9.*l* and 9.*r* are permanently connected to the helmet shell 7 indirectly via the bearing support 8 for the back of the head. The front bearing ring part 5 and the two lateral bearing ring parts 9.*l* and 9.*r* together form a circular bearing ring, which sets the head size, which the safety helmet 100 provides. The front holding ring part 2 and the rear holding ring part 11 form a circular holding ring, which is in contact on the inside with the arched helmet shell 7.

The two rear bearing ring parts 9.*l* and 9.*r* are held by the bearing support 8 for the back of the head and are passed through the bearing support 8 for the back of the head. The bearing support 8 for the back of the head is permanently connected to the helmet shell 7, is in contact with the back of the head of the user of the safety helmet 100 and is preferably likewise provided with a textile sheathing, which is located between the back of the head of the user and the bearing support 8 for the back of the head. The bearing support 8 for the back of the head acts as a spacer and ensures that a distance is formed between the two rear bearing ring parts 9.*l* and 9.*r* and the head of a user. The two rear bearing ring parts 9.*l* and 9.*r* are not provided with a textile sheathing in the exemplary embodiment.

The handwheel 14 is connected to the bearing support 8 for the back of the head. A rotation of the handwheel 14 causes the two rear bearing ring parts 9.*l* and 9.*r* to be moved relative to the bearing support 8 for the back of the head, namely, either towards one another or away from one another, as a result of which the head size is reduced or enlarged.

The inner lining of the safety helmet 100 is omitted in FIG. 1.

The index .l designates a left component, and the index .r designates a right component.

The optional spacer 10 at the intermediate piece 28 comprises a projection 34 and can preferably be rotated about an axis parallel to the upper edge of the front bearing ring part 5. The intermediate piece 28 is optional and it bridges the distance between the front bearing ring part 5 and the front holding ring part 2. It is also possible that the front bearing ring part 5 is connected directly to the front holding ring part 2.

The front holding ring part 2, the rear holding ring part 11, the bearing support 8 for the back of the head, the front bearing ring part 5, the lateral bearing ring parts 9.*l* and 9.*r*, and the optional intermediate piece belong together to the support structure of the safety helmet 100. The front holding ring part 2 and the bearing support 8 for the back of the head are permanently attached to the helmet shell 7. The front bearing ring part 5 is attached to the front holding ring part 2 directly or by means of the intermediate piece 28. This support structure carries the textile inner lining, not shown. The components of the support structure are manufactured from at least one solid but preferably flexible material, for example, from a metal or plastic.

The front bearing ring part 5 is connected to the two rear bearing ring parts 9.*l* and 9.*r* by a respective snap-in connection 31.*l*, 31.*r* each. In the embodiment shown, these snap-in connections 31.*l*, 31.*r* are embodied as follows: Two left, mushroom-shaped projections 33.*l* and two right, mushroom-shaped projections 33.*r*, cf. FIG. 2, which point to the outside and mesh with corresponding recesses 35.*l*, 35.*r* at the left rear bearing ring part 9.*l* and at the right rear bearing ring part 9.*r*, are mounted on the outside at the front bearing ring part 5 close to the two free ends of the horseshoe. In addition, the front bearing ring part 5 is detachably connected to the intermediate piece 28 in one embodiment, for example, by a snap connection or likewise by a snap-in connection, and directly to the front holding ring part 2 in another embodiment. On the whole, the front bearing ring part 5 is consequently connected at three connection points located at spaced locations from one another to additional components 2 or 28, 9.*l*, 9.*r* of the support structure, and it is held securely hereby.

The central rear bearing ring part 8 has the shape of a support for the back of the head and is located between the two lateral bearing ring parts 9.*l* and 9.*r* and is connected to these via a gear mechanism. The front bearing ring part 5 acts as the sheathed bearing element of the exemplary embodiment and forms together with the two rear bearing ring parts 9.*l* and 9.*r* a continuous bearing ring, which sets the head size of the safety helmet 100. The lateral rear bearing ring parts 9.*l*, 9.*r* do not come into contact with the scalp of the user and they are preferably not sheathed therefore.

When the user (or any other person) rotates the handwheel 14, this rotation is transmitted to the two rear bearing ring parts 9.*l*, 9.*r*, and these move relative to the bearing support 8 for the back of the head and relative to the helmet shell 7 synchronously, and in opposite directions, as a result of which the length of the entire bearing ring 5, 9.*l*, 9.*r* and hence the head size provided are changed.

Figure 2:
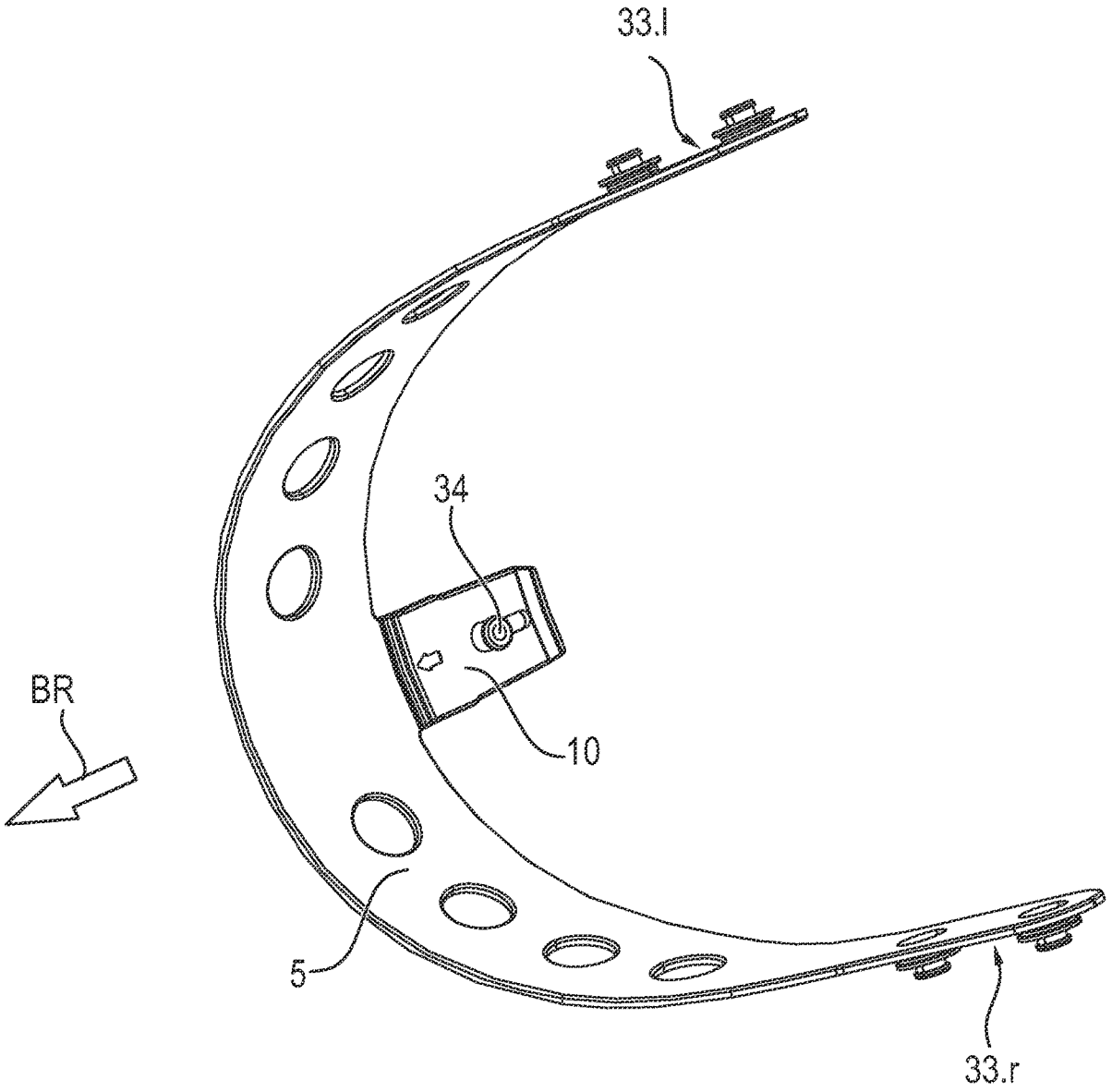
FIG. 2 is a perspective view showing a front bearing ring part.
Figure 3:
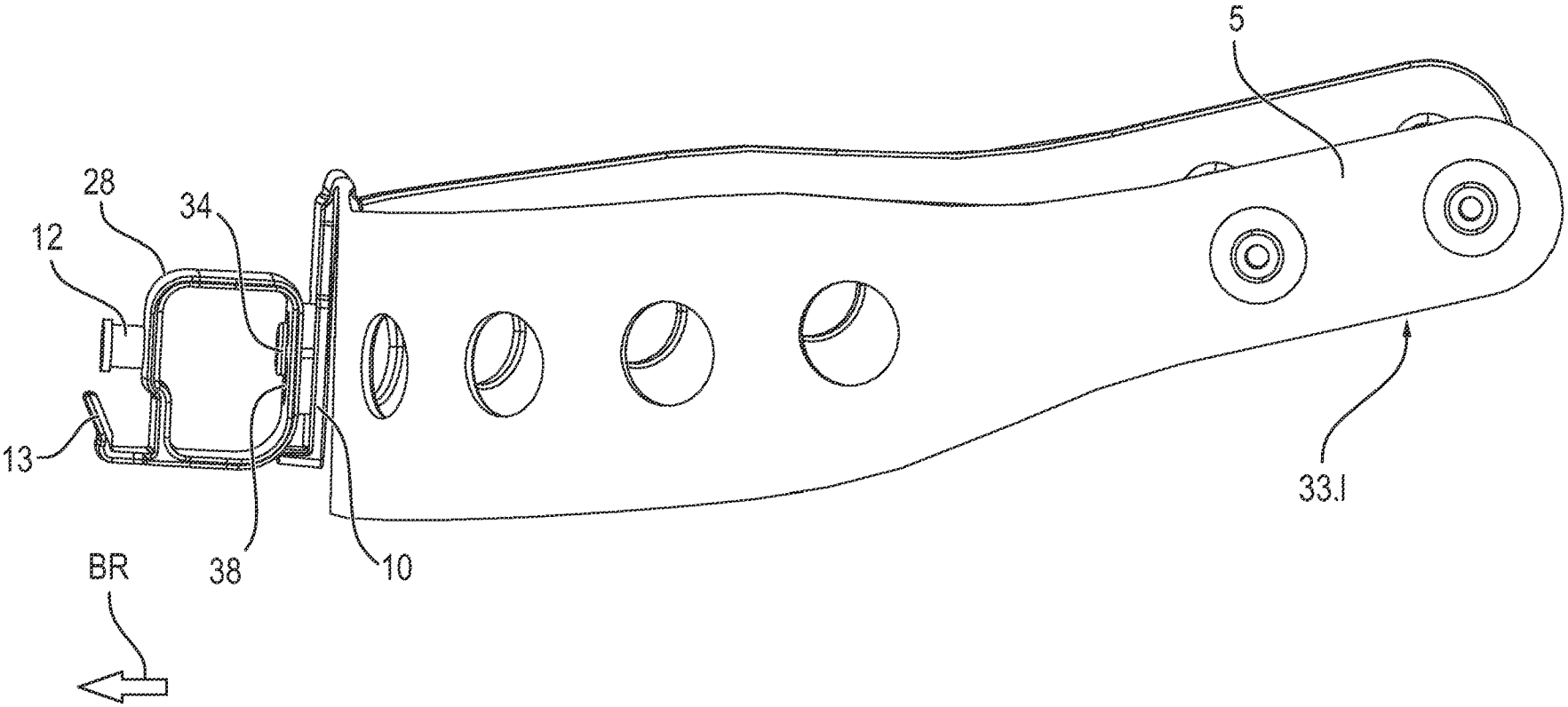
FIG. 3 is a side view showing the front bearing ring part and the optional intermediate piece.
Figure 5:
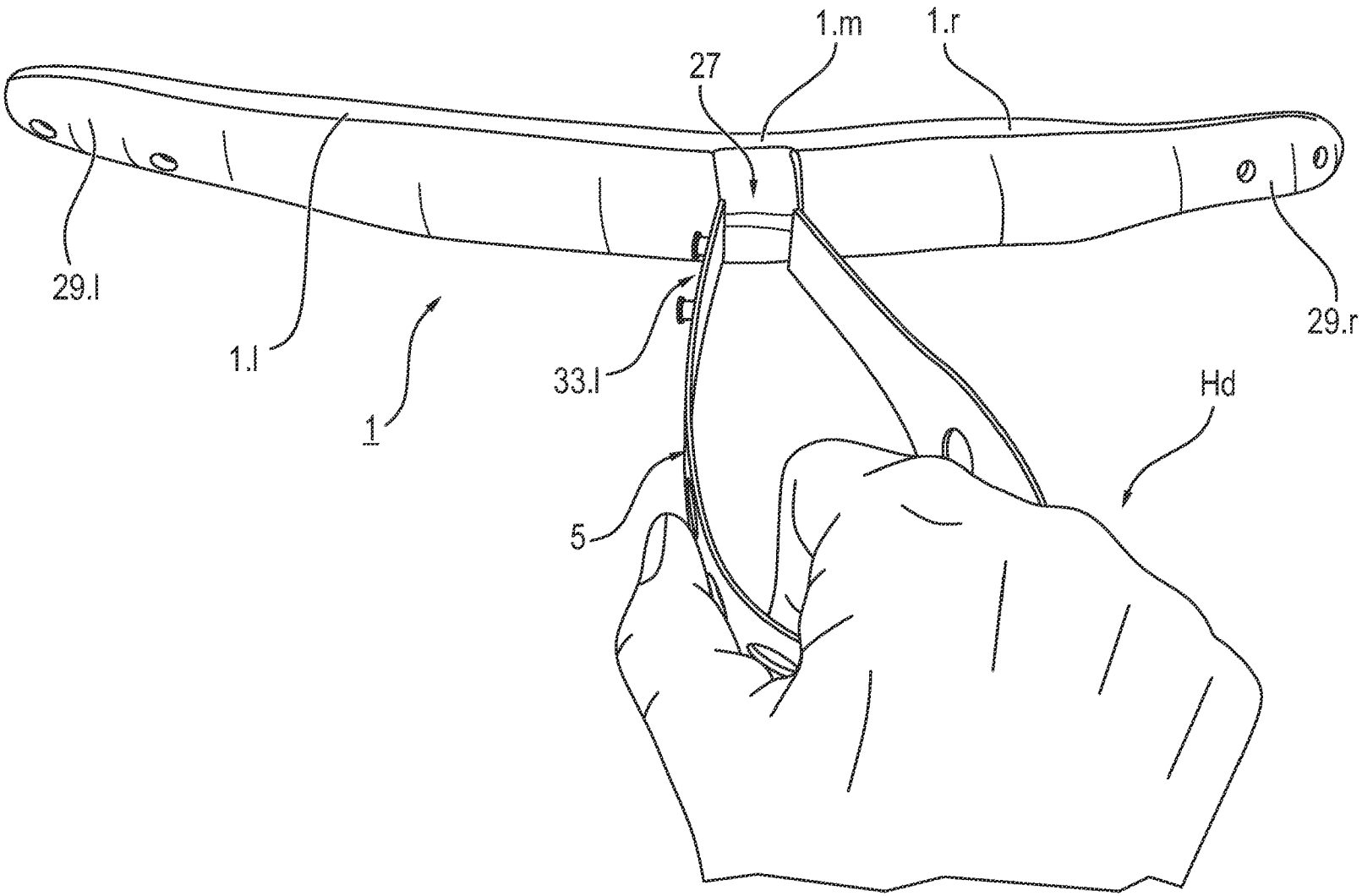
FIG. 5 is a perspective view showing a state that is reached during the removing out of the front bearing ring part from the textile sheathing.

In a perspective view from the viewing direction obliquely from below, FIG. 2 shows the front bearing ring part 5. FIG. 5 shows in a side view from the left the front bearing ring part 5 and the optional intermediate piece 28. The rotatable spacer 10 is located between the front bearing ring part 5 and the intermediate piece 28, cf. FIG. 3. The preferably mushroom-shaped projection 34 at the spacer 10 meshes with the recess 38 at the intermediate piece 28. A mushroom-shaped projection 12 at the intermediate piece 28 points in the viewing direction BR and meshes with a corresponding recess in the front holding ring part 2. A hook-shaped projection 13 at the intermediate piece 28 encloses the front holding ring part 2.

The front bearing ring part 5 adjoins the head of a user and is manufactured from a plastic or from a metal. It can be compressed reversibly, so that the distance between the two legs is reduced. The front bearing ring part 5 encloses the forehead and the temples of a user. In order for the front bearing ring part 5 not to come directly into contact with the scalp of the user, the front bearing ring part 5 is enclosed with a textile sheathing 1, which is in contact with the scalp. This textile sheathing 1 is omitted in FIG. 1, FIG. 2 and FIG. 3. The bearing support 8 for the back of the head is also enclosed in one embodiment by a corresponding textile sheathing, which is not shown in the figures.

The textile sheathing 1 acts as a cushion between the front bearing ring part 5 and the scalp of the user. The textile sheathing of the bearing support 8 for the back of the head correspondingly brings about a cushioning at the back of the head. The lateral rear bearing ring parts 9.*l* and 9.*r* do not come into contact with the scalp of the user and do not therefore need to be necessarily sheathed with a textile material.

The user of the safety helmet 100, for example, a rescue team member, is frequently exposed to chemical pollutants during a mission. Especially many particles of harmful substance may settle in components of the safety helmet 100. The textile components must therefore be cleaned especially thoroughly after a use of the safety helmet 100 in an environment that may have particles of harmful substances. Therefore, and since textile components are to be cleaned, as a rule, in a different manner than the other components of the safety helmet 100, the textile components must be separated from the other components of the safety helmet 100 and cleaned separately.

The sheathed bearing ring part 5, i.e., the front bearing ring part 5 together with the textile sheathing 1, must be cleaned in some applications. If the material of the front bearing ring part 5 is suitable for this cleaning operation, this is a preferred application, because the step of removing the front bearing ring part 5 from the textile sheathing 1 is eliminated. It is necessary for the cleaning in other applications to remove the sheathed front bearing ring part 5 out of the safety helmet 100 after a use and subsequently to remove the front bearing ring part 5 from the textile sheathing 1. The sheathing must be restored after the cleaning. In addition, the situation in which the textile sheathing 1 is worn or torn and must be replaced may occur. It is also possible that the front bearing ring part 5 is damaged and must be replaced. It is necessary in all cases to remove the sheathed front bearing ring part 5 from the safety helmet 100, which is easily possible thanks to the present invention.

The embodiment described below makes do without a connection by connection in substance and especially without a bonded connection or without a VELCRO® fastener for the textile sheathing 1 or for the sheathed bearing element 5.

Figure 4B:
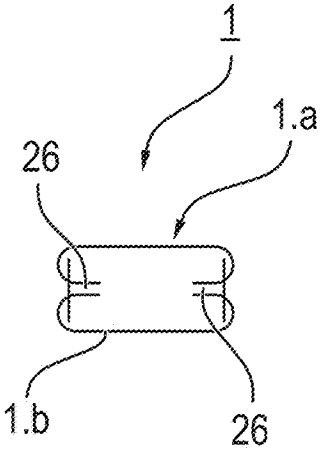
FIG. 4A and FIG. 4B are views showing the textile sheathing in two sectional drawings.
Figure 4A:
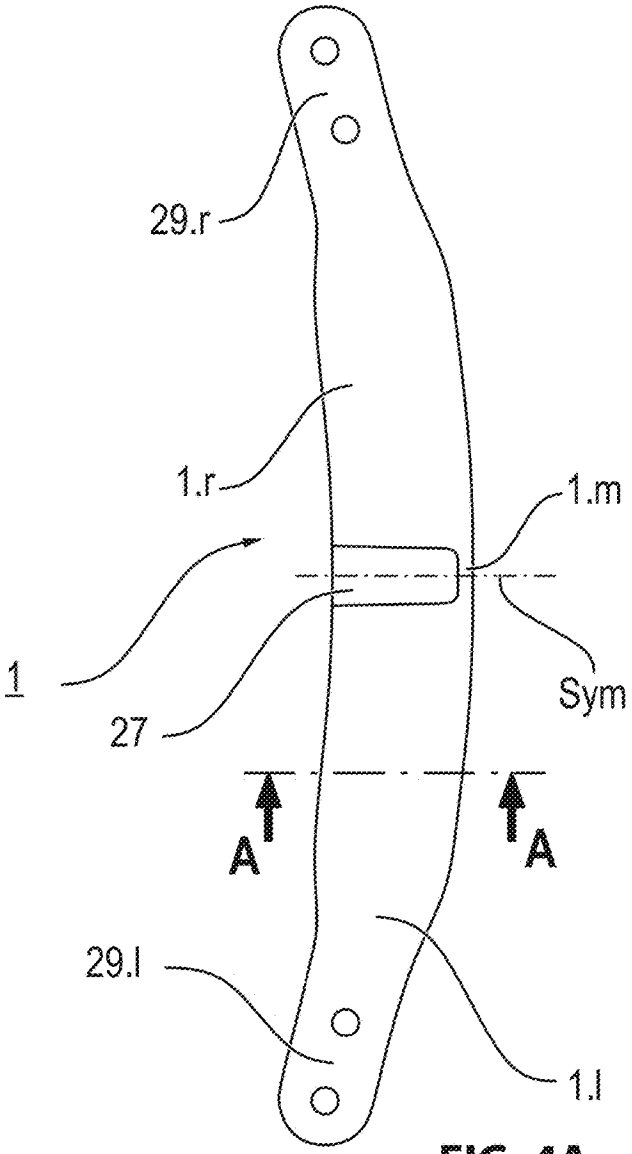

FIG. 4A and FIG. 4B show in two sectional drawings the textile sheathing 1 without the front bearing ring part 5. The textile sheathing 1 comprises

- a left hose 1.*l*,
- a right hose 1.*r*,
- a web 1.*m*, which connects the two hoses 1.*l* and 1.*r* to one another,
- two circular left connection openings 29.*l* in the left hose 1.*l* for the two projections 33.*l* of the left snap-in connection 31.*l*,
- two circular right connection openings 29.*l* in the right hose 1.*r* for the two projections 33.*r* of the right snap-in connection 31.*r*, and
- a circular connection web 26 in the interior of the textile sheathing 1.

The textile sheathing 1 is preferably mirror-symmetrical to a symmetry plane Sym, which is at right angles to the drawing plane of FIG. 4A. The web 1.*m* encloses a connection opening in the form of an insertion opening 27 between the two hoses (tubes) 1.*l* and 1.*r*. A reinforcing seam is preferably placed around this insertion opening 27. The insertion opening 27 is dimensioned such that the front bearing ring part 5 fits through the insertion opening 27 when the front bearing ring part 5 is compressed to a sufficiently great extent in the manner of tongs. In addition, the spacer 10 protrudes from the insertion opening 27 even when the spacer 10 is rotated in the direction of the front bearing ring part 5 and the front bearing ring part 5 is inserted in, cf. FIG. 3. The textile sheathing 1 encloses the front bearing ring part 5 fully with the exception of the central insertion opening 27 and the lateral connection openings 29.*l* and 29.*r*. In particular, the two ends of the tubular shape textile sheathing 1, which are located close to the two connection openings 29.*l* and 29.*r*, are closed. The textile sheathing 1 preferably encloses the front bearing ring part 5 fully, aside from the openings 27, 29.*l*, 29.*r*.

The two left projections 33.*l* at the left leg of the front bearing ring part 5 are passed through the two left connection openings 29.*l* in the textile sheathing 1, and the two right projections 33.*r* are passed through the two right connection openings 29.*r*. The projections 33.*l*, 33.*r* mesh with corresponding recesses 35.*l*, 35.*r* of the two rear bearing ring parts 9.*l*, 9.*r*, cf. FIG. 1. The snap-in connections 31.*l*, 31.*r* are thus embodied by the textile sheathing 1. The detachable connection between the front bearing ring part 5 and the intermediate piece 28 or the front holding ring part 2 is also embodied by an opening in and through the textile sheathing 1, namely, through the insertion opening 27. On the whole, three detachable connections are thus embodied by three openings 27, 29.*l*, 29.*r*, which are located at spaced locations from one another in space, in the textile sheathing 1. The textile sheathing 1 is thus held sufficiently securely in a desired position relative to the front bearing ring part 5 and it cannot, in particular, slip, as a rule, substantially. It is therefore unnecessary to attach the textile sheathing 1 at the support structure in another manner, especially not by a bonded connection or by a welded connection or by a VELCRO® connection or by means of buttons.

As can be seen on the right side of the sectional drawing in FIG. 4B, the textile sheathing 1 comprises two mirror symmetrical components 1.*a* and 1.*b*. These two components 1.*a*, 1.*b* are attached to one another in the circular connection web 26. In the process of preparing the textile sheathing 1, the two components 1.*a* and 1.*b* are connected to one another in the connection web 26, the connection being carried out before or even after the bearing element 5 has been inserted. This connection does not need to be separated thereafter any longer, especially not in order to remove the front bearing ring part 5 from the textile sheathing 1.

Figure 6:
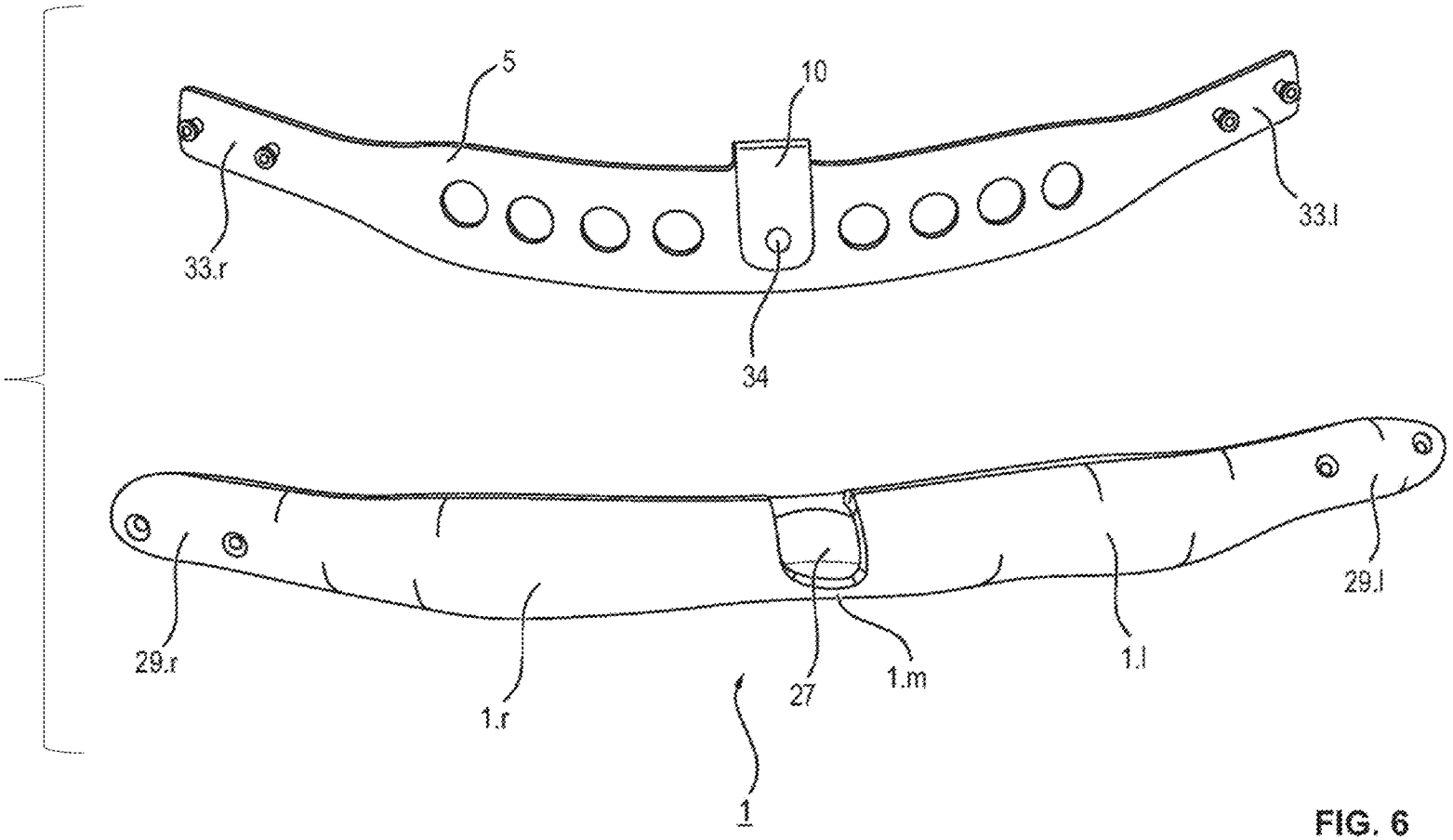
FIG. 6 is a perspective view showing the front bearing ring part and the textile sheathing after the front bearing ring part has been removed out of the textile sheathing.

FIG. 5 and FIG. 6 illustrate how the front bearing ring part 5 is removed from the textile sheathing 1. The two snap-in connections 31.*l* and 31.*r* were separated before, and the front bearing ring part 5 was removed from the intermediate piece 28 or from the front holding ring part 2. The sheathed front bearing ring part 5 was removed from the safety helmet 100.

A user reaches with one hand Hd through the insertion opening 27 into the interior of the textile sheathing 1 and grasps the horseshoe-shaped front bearing ring part 5 approximately in the middle. The front bearing ring part 5 is made of an elastic material and can be compressed reversibly. The user removes the front bearing ring part 5, grasped approximately in the middle, through the insertion opening 27 out of the textile sheathing 1. FIG. 5 shows a situation in which the front bearing ring part 5 has been pulled over more than half out of the textile sheathing 1. The situation shown in FIG. 6 occurs after the front bearing ring part 5 has been removed completely out of the textile sheathing 1. The textile sheathing 1 and the front bearing ring part 5 can be cleaned or replaced now separately from one another. The bearing element 1 is shown in FIG. 6 at the top and the textile sheathing 1 is shown at the bottom.

Figure 7:
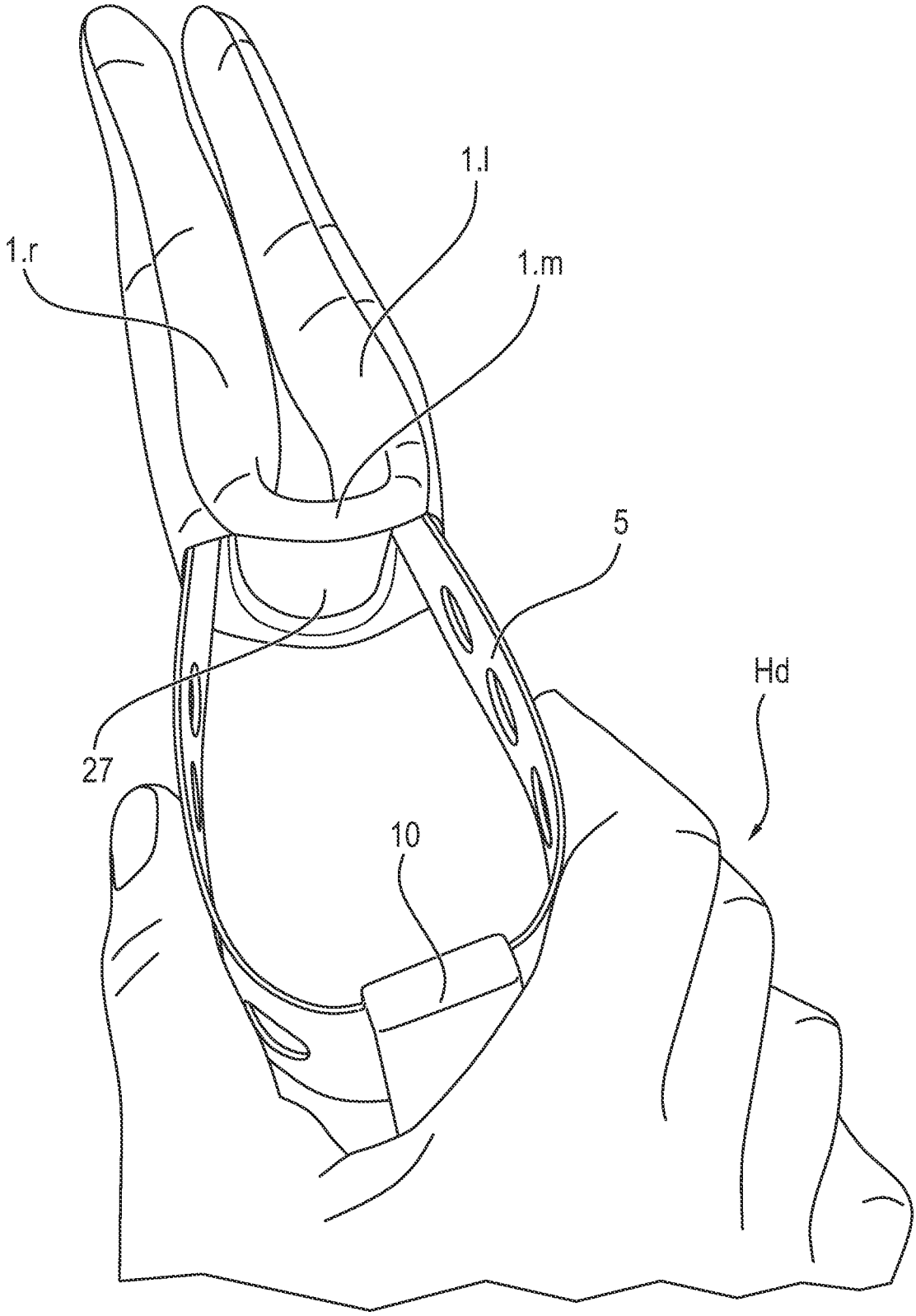
FIG. 7 is a perspective view showing a state that is reached while the front bearing ring part is being inserted into the textile sheathing: the front bearing ring part is compressed and is inserted partially into the textile sheathing.
Figure 8:
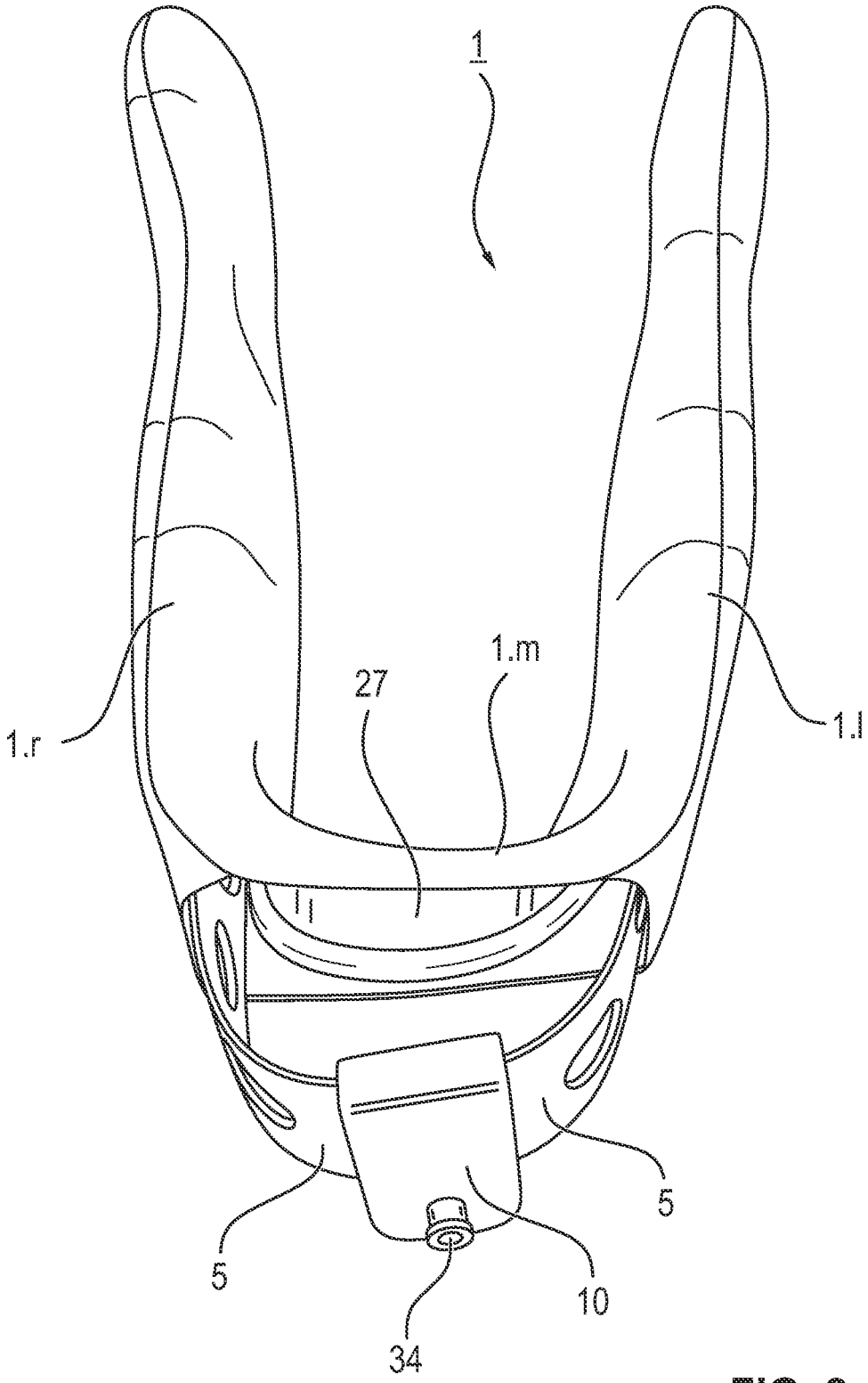
FIG. 8 is a perspective view showing a state in which the front bearing ring part is inserted nearly completely into the textile sheathing.
Figure 9:
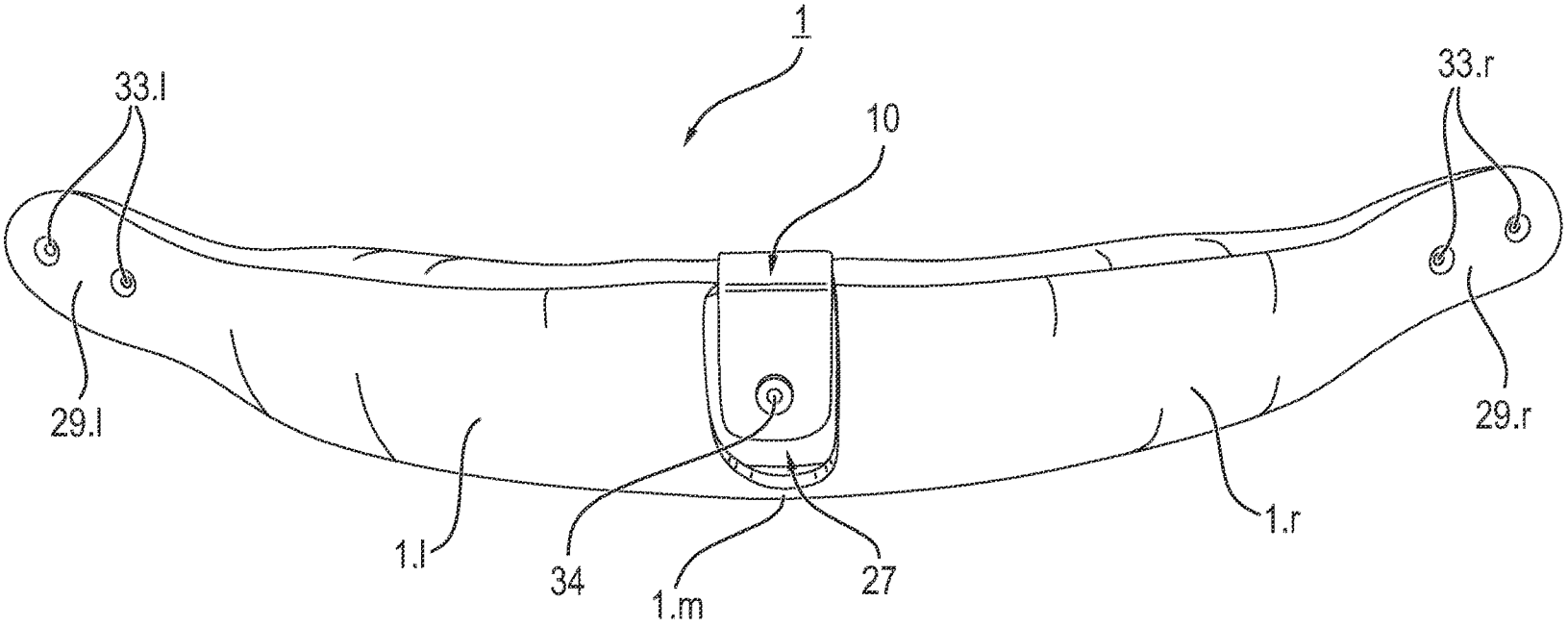
FIG. 9 is a perspective view showing a situation in which the front bearing ring part is inserted completely into the textile sheathing and is enclosed by this.

FIG. 7, FIG. 8 and FIG. 9 show how the front bearing ring part 5 is inserted into the textile sheathing 1. The procedure of inserting the bearing ring part 5 can be carried out during the manufacture of the safety helmet 100 or after a separate cleaning or at the time of a replacement of the textile sheathing 1.

The front bearing ring part 5 is compressed in the manner of tongs. The two legs of the compressed front bearing ring part 5 are inserted through the insertion opening 27 into the two hoses (tubes) 1.*l* and 1.*r*, respectively, of the textile sheathing 1 until the textile sheathing 1 fully encloses the front bearing ring part 5, cf. FIG. 8. The textile sheathing 1 is positioned relative to the front bearing ring part 5 such that the projections 33.*l* and 33.*r* project from the corresponding connection opening 29.*l* and 29.*r*. FIG. 8 shows a situation that is reached shortly before the inserting in has become complete. FIG. 9 shows the front bearing ring part 5 after this has been inserted completely into the textile sheathing 1. The spacer 10 protrudes from the insertion opening 27. The projections 33.*l*, 33.*r* protrude from the corresponding connection openings 29.*l*, 29.*r*. The front bearing ring part 5 preferably stresses the textile sheathing 1 from the inside, so that the textile sheathing 1 can move only slightly to the front bearing ring part 5. The sheathed front bearing ring part 5 can be connected now to the components 2 or 28, 8, 9.*l*, 9.*r* of the support structure.

Figure 10:
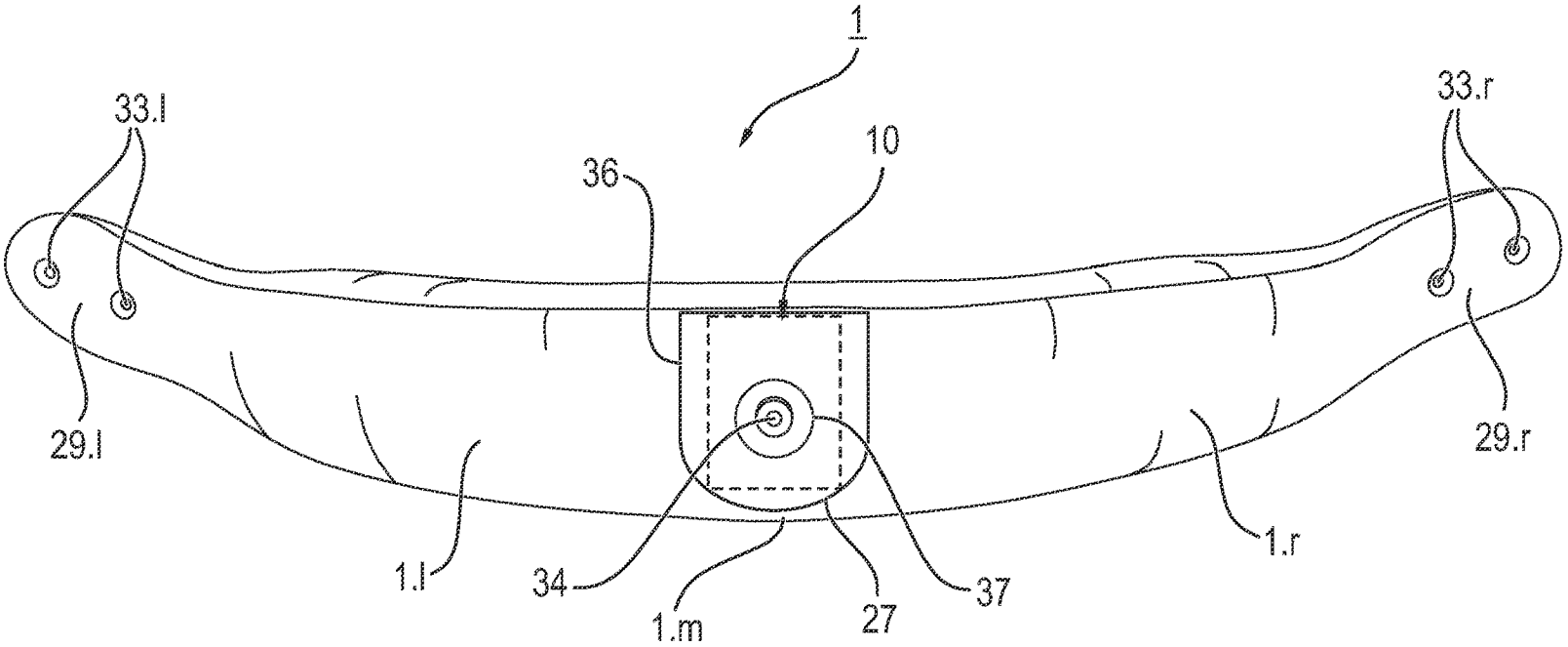
FIG. 10 is a perspective view showing a different embodiment, in which the insertion opening is reduced in size with a textile closure.

FIG. 10 illustrates an alternative embodiment. The insertion opening 27 is used only during the manufacture of the safety helmet 100. The front bearing ring part 5 is brought during the manufacture into the interior of the textile sheathing the insertion opening 27, as this was described farther above with reference to FIG. 7 through FIG. 9. After the situation shown in FIG. 9 has been established, a textile closure 36 is placed on the insertion opening 27, for example, by the textile closure 36 being sewn onto the textile sheathing 1. This textile closure 36 leaves the connection opening 37 free. The spacer 10 is located behind this textile closure 36 and is suggested by broken line in FIG. 10. The projection 34 at the spacer 10 protrudes from the connection opening 37. The connection opening 37 is so small that the front bearing ring part 5 cannot be removed from the textile sheathing 1 nor can it slide out of it.

On the other hand, the connection opening 37 is so large that a detachable connection can be established through the connection opening 37 between the front bearing ring part 5 and the intermediate piece 28 or the front holding ring part 2. The projection 34 at the spacer 10 is inserted in the exemplary embodiment into the recess 38 at the intermediate piece 28 through the connection opening 37.

While specific embodiments of the invention have been shown and described in detail to illustrate the application of the principles of the invention, it will be understood that the invention may be embodied otherwise without departing from such principles.

LIST OF REFERENCE CHARACTERS

1 Textile sheathing for the front bearing ring part 5; it comprises the left hose 1.*l*, the right hose 1.*r*, the web 1.*m*, the insertion opening 27 and the lateral connection openings 29.*l*, 29.*r*; it is manufactured from the components 1.*a* and 1.*b*

1.*a*, 1.*b* Components of the textile sheathing 1, permanently connected to one another in the connection web 26

1.*l* Left hose of the textile sheathing 1; it accommodates the left leg of the front bearing ring part 5

1.*m* Web between the left hose (tube) 1.*l* and the right hose (tube) 1.*r*; it connects the two hoses (tubes) 1.*l* and 1.*r* to one another; it encloses the insertion opening

1.*r* Right hose of the textile sheathing 1; it receives the right leg of the front bearing ring part 5

2 Front holding ring part; it is in contact with the shock-absorbing shell 6; connected to the intermediate piece 28

4 Pivotable visor, serves as a face protection

5 Front bearing ring part; it acts as the bearing element; comprises the spacer 10 and the mushroom-shaped projections 33.*l*, 33.*r*; it is detachably connected to the rear bearing ring parts 9.*l*, 9.*r* and to the intermediate piece 28; enclosed by the textile sheathing 1

6 Arched shock-absorbing shell; it lies inside in the helmet shell 7; absorbs kinetic energy

7 Arched helmet shell, in which the support structure 2, 5, 8, 9.*l*, 9.*r* is attached on the inside; it carries the handwheel 14

8 Central rear bearing ring part in the form of a cushioned support for the back of the head; it is arranged between the bearing ring parts 9.*l* and 9.*r*; it is attached on the inside to the helmet shell 7

9.*l* Left rear bearing ring part; connected detachably to the front bearing ring part 5 by means of the snap-in connection 31.*l*

9.*r* Right rear bearing ring part; connected detachably to the front bearing ring part 5 by means of the snap-in connection 31.*r*

10 Rotatable spacer of the front bearing ring part 5, passed through the central insertion opening 27; it comprises the projection 34

11 Rear holding ring part; attached to the helmet shell 7

12 Mushroom-shaped projection at the intermediate piece 28; it meshes with a corresponding recess in the front holding ring part 2

13 Hook-shaped projection at the intermediate piece 28; it encloses the front holding ring part 2

26 Circular connection web in the interior of the textile sheathing 1; it connects the two components 1.*a* and 1.*b* permanently to one another

27 Central insertion opening in the textile sheathing 1, through which the front bearing ring part 5 can be inserted into the textile sheathing 1 and can again be removed out of same; enclosed by a seam

28 Optional intermediate piece between the front holding ring part 2 and the front bearing ring part 5; it can be detachably connected to the spacer 10

29.*l* Left connection openings in the textile sheathing 1 for the left locking opening 31.*l*; they enclose the left projections 33.*l*, 33.*r*

29.*r* Right connection openings in the textile sheathing 1 for the right snap-in connection 31.*r*; they enclose the right projections 33.*l*, 33.*r*

31.*l* Snap-in connection between the front bearing ring part 5 and the left rear bearing ring part 9.*l*; established through the left connection openings 29.*l*

31.*r* Snap-in connection between the front bearing ring part 5 and the right rear bearing ring part 9.*r*; established through the right connection openings 29.*r*

32 Sunglasses in the form of an additional visor, attached pivotably to the front holding ring part 2

33.*l* Pair comprising two left mushroom-shaped projections at the front bearing ring part 5; together with corresponding recesses 35.*l* at the left rear bearing ring part 9.*l*, it makes it possible to establish the detachable snap-in connection 31.*l* between the front bearing ring part 5 and the rear bearing ring part 9.*l*, wherein the projections are passed through the left connection openings 29.*l*

33.*r* Pair comprising two right mushroom-shaped projections at the front bearing ring part 5; it makes it possible together with corresponding recesses 35.*r* at the right rear bearing ring part 9.*r* to establish the detachable snap-in connection 31.*r* between the front bearing ring part 5 and the rear bearing ring part 9.*r*, wherein the projections is passed through the right connection openings 29.*r*

34 Projection at the spacer 10; it can be detachably connected to the recess 38 at the intermediate piece 28 through the insertion opening 27 or through the connection opening 37

35.*l* Pair comprising two recesses in the left bearing ring part 9.*l*; it can be detachably connected to the projections 33.*l*

35.*r* Pair comprising two recesses in the right bearing ring part 9.*r*; it can be detachably connected to the projections 33.*r*

36 Textile closure for the insertion opening 27; it leaves the connection opening 37 free

37 Connection opening for the projection 34; it is formed after placing the textile closure on the insertion opening 27

38 Recess at the intermediate piece 28; it makes it possible together with the projection 34 to establish a detachable snap-in connection between the front bearing element part 5 and the intermediate piece 28

100 Safety helmet; it comprises the helmet shell 7, the shock-absorbing shell 6, the holding ring parts 2, 11, the bearing ring parts 5, 8, 9.*l*, 9.*r*, the intermediate piece 28, the handwheel 14 and the textile sheathing 1

BR Viewing direction of a user of the safety helmet 100, who is looking straight forward Hd Right hand of a user, who inserts the front bearing ring part 5 into the textile sheathing 1 and removes same out of the textile sheathing 1

Sym Symmetry plane of the textile sheathing 1; it extends through the insertion opening 27

What is claimed is:

1. A safety helmet comprising:

an arched helmet shell;

a bearing element;

at least one holding element permanently connected to the helmet shell; and a tubular-shaped textile sheathing, wherein:

the safety helmet is configured such that when the safety helmet is located on the head of a user of the safety helmet, a distance is present between the at least one holding element and the head, the bearing element is adjacent to the head, and an area of the textile sheathing is located between the bearing element and the head;

the textile sheathing encloses the bearing element and has a first connection opening being configured as an insertion opening and at least one other connection opening, the at least one other connection opening being located at a location spatially remote from the insertion opening;

the combination of the bearing element with the textile sheathing is detachably connectable to the at least one holding element through the at least one other connection opening such that the bearing element in the textile sheathing is removably attached to the at least one holding element and is removable from the helmet shell; and the insertion opening is dimensioned such that the bearing element is insertable into the textile sheathing through the insertion opening and is removable out of the textile sheathing through the insertion opening.

2. A safety helmet in accordance with claim 1, wherein the combination of the bearing element with the textile sheathing is detachably connectable to the at least one holding element through the insertion opening and through the at least one other connection opening such that the bearing element in the textile sheathing is removably attached to the at least one holding element at two points spatially remote from each other and is removable from the helmet shell.

3. A safety helmet in accordance with claim 1, wherein:

the at least one holding element is a first holding element and the safety helmet comprises at least another holding element being a second holding element, wherein the two holding elements are permanently connected to the helmet shell, wherein the textile sheathing has at least two connection openings located at locations spaced from one another and from the insertion opening; and the bearing element in the textile sheathing is detachably connectable to the two different holding elements through a respective one of the at least two connection openings.

4. A safety helmet in accordance with claim 3, wherein:

the two holding elements, with which the bearing element is detachably connectable, are movable relative to one another; and a head size provided by the safety helmet is changeable by a movement of one of the holding elements relative to the other one of the holding elements.

5. A safety helmet in accordance with claim 3, further comprising a spacer permanently connected to the helmet shell, wherein the spacer holds the two holding elements such that when the safety helmet is located on the head of the user of the safety helmet, a respective distance is present between each of the two holding elements and the head.

6. A safety helmet in accordance with claim 1, wherein the bearing element has at least one projection that extends through the first or the other connection opening and is configured to be received by a corresponding recess of the at least one holding element; or the at least one holding element has at least one projection that extends through the first or the other connection opening and is configured to be received by a corresponding recess of the bearing element.

7. A safety helmet in accordance with claim 1, wherein the bearing element and the textile sheathing are configured such that the bearing element is held in the textile sheathing and the bearing element is prevented from sliding out of the textile sheathing.

8. A safety helmet in accordance with claim 1, wherein:

the textile sheathing has a shape of a hose with two ends;

the two ends are each closed, and the at least one connection opening is spaced a distance to each of the two ends.

9. A safety helmet in accordance with claim 1, wherein:

the textile sheathing comprises two hose portions each having an end being spatially remote from the insertion opening and being closed;

the insertion opening is located between the two hose portions;

the at least one other connection opening is located in a respective one of the hose portions; and each hose portion receives a respective area of the bearing element.

10. A safety helmet in accordance with claim 9, wherein the two hose portions are mirror-symmetrical to each other in relation to the insertion opening.

11. A safety helmet in accordance with claim 1, wherein:

the bearing element is reversibly compressible;

in a compressed state, the bearing element exerts a restoring force, which biases the bearing element into a resting state;

in the compressed state, the bearing element is insertable through the insertion opening into the textile sheathing;

in the compressed state, the bearing element is removable out of the textile sheathing through the insertion opening; and in a resting state, the bearing element has in each direction in the plane of the insertion opening a larger dimension than the insertion opening.

12. An arrangement comprising:

a safety helmet comprising: an arched helmet shell; a bearing element; at least one holding element permanently connected to the helmet shell; and a tubular-shaped textile sheathing, wherein: the safety helmet is configured such that when the safety helmet is located on the head of a user of the safety helmet, a distance is present between the at least one holding element and the head, the bearing element is adjacent to the head, and an area of the textile sheathing is located between the bearing element and the head; the textile sheathing encloses the bearing element and has a first connection opening being configured as an insertion opening and at least one other connection opening, the at least one other connection opening being located at a location spatially remote from the insertion opening; and the combination of the bearing element with the textile sheathing is detachably connectable to the at least one holding element through the at least one other connection opening such that the bearing element in the textile sheathing is removably attached to the at least one holding element and is removable from the helmet shell, the insertion opening being dimensioned such that the bearing element is insertable into the textile sheathing through the insertion opening and is removable out of the textile sheathing through the insertion opening;

an additional tubular-shaped textile sheathing;

an additional bearing element, which is enclosed by the additional tubular-shape textile sheathing, wherein:

the additional textile sheathing has at least one additional connection opening;

the safety helmet is selectively useable in a first configuration or in a second configuration;

in the first configuration, the bearing element in the textile sheathing is detachably connected to the at least one holding element through the first connection opening; and in the second configuration, the additional bearing element in the additional textile sheathing is detachably connected to the at least one holding element through the at least one additional connection opening.

13. A safety helmet process comprising:

providing a safety helmet comprising: an arched helmet shell; a bearing element; at least one holding element permanently connected to the helmet shell; and a tubular-shape textile sheathing, wherein: the safety helmet is configured such that when the safety helmet is located on the head of a user of the safety helmet, a distance is present between the at least one holding element and the head, the bearing element is adjacent to the head, and an area of the textile sheathing is located between the bearing element and the head; the textile sheathing encloses the bearing element and has a first connection opening being configured as an insertion opening and at least one other connection opening, the at least one other connection opening being located at a location spatially remote from the insertion opening; and the combination of the bearing element with the textile sheathing is detachably connectable to the at least one holding element through the at least one connection opening such that the bearing element in the textile sheathing is removably attached to the at least one holding element and is removable from the helmet shell, the insertion opening being dimensioned such that the bearing element is insertable into the textile sheathing through the insertion opening and is removable out of the textile sheathing through the insertion opening; and removing the textile sheathing from the safety helmet comprising the steps of:

detaching the connection of the bearing element, enclosed by the textile sheathing, from the at least one holding element; and removing the bearing element together with the textile sheathing from the safety helmet.

14. A safety helmet process in accordance with claim 13, wherein:

the bearing element is cleaned together with the textile sheathing, after performing the step of removing the bearing element with the textile sheathing from the safety helmet; and after the cleaning step, the bearing element with the textile sheathing is detachably connected to the at least one holding element or to a respective holding element through the connection opening or through at least one connection opening of the textile sheathing.

15. A process according to claim 13, further comprising providing a computer program, which is executable on a computer and causes the computer during the execution to actuate one or more 3D printers such that an actuated 3D printer produces the bearing element, an actuated 3D printer produces the holding element and an actuated 3D printer produces the tubular-shape textile sheathing.

16. A process according to claim 13, further comprising providing a 3D printer, which is configured to produce at least one of the bearing element, the holding element and the tubular-shape textile sheathing.

17. A process for manufacturing a safety helmet comprising: an arched helmet shell; a bearing element; at least one holding element permanently connected to the helmet shell; and a tubular-shape textile sheathing, wherein: the safety helmet is configured such that when the safety helmet is located on the head of a user of the safety helmet, a distance is present between the at least one holding element and the head, the bearing element is adjacent to the head, and an area of the textile sheathing is located between the bearing element and the head; the textile sheathing encloses the bearing element and has a first connection opening being configured as an insertion opening and at least one other connection opening, the at least one other connection opening being located at a location spatially remote from the insertion opening; and the combination of the bearing element with the textile sheathing is detachably connectable to the at least one holding element through the at least one other connection opening such that the bearing element in the textile sheathing is removably attached to the at least one holding element and is removable from the helmet shell, the process comprising the steps of:

providing the helmet shell, the bearing element, the at least one holding element and a flat object comprising a textile material;

connecting the bearing element to the flat object such that the tubular-shape textile sheathing around the bearing element is formed from the flat object by the connection;

permanently connecting the at least one holding element to the helmet shell; and detachably connecting the bearing element in the textile sheathing to the at least one holding element through the at least one connection opening, wherein the step of connecting the bearing element with the textile sheathing comprises the steps of forming the flat object to the tubular textile sheathing and inserting the bearing element through the insertion opening of the textile sheathing into the textile sheathing; and the step of connecting the bearing element to the at least one holding element comprises the step of detachably connecting the bearing element in the textile sheathing to the at least one holding element through the insertion opening and through the at least one additional connection opening.

18. A process in accordance with claim 17, wherein:

the bearing element is reversibly compressible;

the tubular-shape textile sheathing has two closed ends;

the insertion opening is arranged between the two closed ends;

the step of inserting the bearing element through the insertion opening into the interior of the textile sheathing comprises the steps of:

compressing the bearing element;

inserting the bearing element in a compressed state through the insertion opening into the textile sheathing; and letting the bearing element in the textile sheathing be transferred to a resting state via a restoring force of the compressed bearing element; and wherein the bearing element has a larger dimension than the insertion opening in the resting state in each direction in a plane of the insertion opening.

19. A process in accordance with claim 18, wherein after the step of inserting the bearing element into the textile sheathing, the following additional steps are carried out:

a textile closure is placed on the insertion opening such that a connection opening of a reduced size, which is smaller than the insertion opening and through which the bearing element is detachably connectable to the holding element, is formed from the insertion opening; and the bearing element is detachably connected to this holding element through the connection opening having the reduced size.

* * * * *